United States Patent [19]

Ballew

[11] 4,270,232

[45] Jun. 2, 1981

[54] THERMAL POOL COVER

[76] Inventor: Ray D. Ballew, 3668 Bronco, Las Vegas, Nev. 89103

[21] Appl. No.: 656,787

[22] Filed: Feb. 10, 1976

[51] Int. Cl.[3] ..... E04H 3/19; F24J 3/02

[52] U.S. Cl. ..... 4/498; 126/415

[58] Field of Search ..... 4/172, 172.12, 172.13, 4/172.14, 498–503, 494, 495, 557, 558, 580; D25/2, 4; 114/0.5 F, 256; 126/415, 416

[56] References Cited

U.S. PATENT DOCUMENTS

| | | | |
|---|---|---|---|
| 3,072,920 | 1/1963 | Yellott | 4/172.12 |
| 3,453,666 | 7/1969 | Hedges | 4/172 |
| 3,769,639 | 11/1973 | Bishop | 4/172.12 |
| 3,872,522 | 3/1975 | Bennett | 4/172.12 |
| 3,927,427 | 12/1975 | Aine | 4/172.14 |
| 3,938,338 | 2/1976 | Cullen | 4/172 X |

FOREIGN PATENT DOCUMENTS

| | | | |
|---|---|---|---|
| 13780 | of 1928 | Australia | 4/172.12 |

*Primary Examiner*—Stuart S. Levy
*Attorney, Agent, or Firm*—Herbert C. Schulze

[57] ABSTRACT

This invention is a unique cover for swimming pools or the like manufactured in easily handleable small segments which fit together on matching sides when floated upon water and as particularly characterized by utilizing a heat retaining material on the side facing the water, with a heat admitting cover on the other side with a space formed between the two to provide an insulating space which passes and amplifies heat from the atmosphere into the water while blocking the escape of heat from the water.

4 Claims, 10 Drawing Figures

THERMAL POOL COVER

CROSS REFERENCE TO RELATED PATENT APPLICATIONS

There are no patent applications filed by me related to this invention.

BACKGROUND OF THE INVENTION

1. Field of the Invention

This invention is in the general field of covers for open bodies of water, particularly swimming pools, and is more particularly directed to a thermally effective cover designed to entrap and magnify atmospheric heat and pass the same into the water and retain it, and is particularly directed to such a device in segments which fit together when floated upon a surface.

2. Description of the Prior Art

There is considerable prior art in the field of swimming pool covers and the like. There are segmented covers which consist of a multiplicity of hinged segments to cover a pool; There are fabric and plastic covers designed to be stretched across a pool; There are inflatable fabric covers designed to spread over an entire pool; There are the so called "lily pads" which are plastic elements designed to float upon the surface.

The large majority of the covering arrangements in the prior art are directed solely to prevention of evaporation; Safety purposes to prevent persons falling into a pool, items to prevent icing or contamination, and the like.

There have, also, been some efforts to provide fabric or plastic covers for pools designed to limit the escape of heat from the water or to attempt to enhance the absorbtion by the water of heat from the sun, and the atmosphere, while attempting to prevent the escape of heat.

While all of the prior art has a general bearing upon the subject of the present invention, there is not prior art incorporating shaped segments which will nest together upon the surface of the pool and wherein heat collecting space is provided between an upper and lower surface of said segments with the surfaces so treated as to enhance the collection of thermal energy from the sun or the atmosphere, enhance the transfer of the same into the pool, and retard the escape of heat from the pool by convection or the like. In these particulars, the present invention is unique by comparison to the prior art.

SUMMARY OF THE INVENTION

In the past several years there has been a great increase in the number of private swimming pools installed for individual family (or collective living unit) use. A great number of such pools are heated by electricity, gas, oil, or the like. In certain climates, the heat escapes very rapidly from such pools, particularly during the night, or other times when the atmosphere is cool by comparison to the water temperature.

A number of persons have worked in this general field and have found that certain types of covers over the pool during night time hours and the like will reduce the amount of heat loss. In addition, it has been found that plastic covers and the like will sometimes enhance the heating of a pool if left on during certain sunlight hours.

The pool covers so far in general use, however, are inconvenient for use by the average individual, are difficult to store when not in use, and are seldom fully effective in trapping atmospheric heat and passing the same into the water as well as inhibiting the escape of such heat from the water during night time hours and the like, especially such escape by convection.

I have given a great deal of study to this overall problem and have made a number of interesting discoveries. The result has been a new, unique, and greatly improved pool cover arrangement by which a pool cover traps great amounts of solar or atmospheric energy, transmits the same into a pool, at the same time inhibiting any loss thereof from the pool during night time hours or the like.

My discoveries also have resulted in a segmented cover adaptable to fit any size pool with no waste or excess material, and of such nature as to be easily handled by any person, even a child.

My invention includes a number of alternative construction plans, all directed at shaped, preferably hexagonal, frames being essentially open between their sides, and having heat collecting and transferring cover material upon one side with a covering on the other side adapted to pass the heat collected into the water, but so constructed as to inhibit the escape of the heat from the water during adverse atmospheric conditions.

It is an object of this invention to provide a unique segmented pool cover easily handleable by any person;

Another object of this invention is to provide such a pool cover which covers any size or shape pool without the use of excessive unrequired material;

Another object of this invention is to provide such a pool cover as described wherein atmospheric heat and energy is collected and transferred into the water of a pool;

Another object of this invention is to provide such a cover as described wherein the escape of heat from the water of a pool is inhibited.

The foregoing and other objects and advantages of this invention will become apparent to those skilled in the art upon reading the following description of a preferred embodiment in conjunction with the appended drawings.

DESCRIPTION OF A PREFERRED EMBODIMENT

Figure 1:
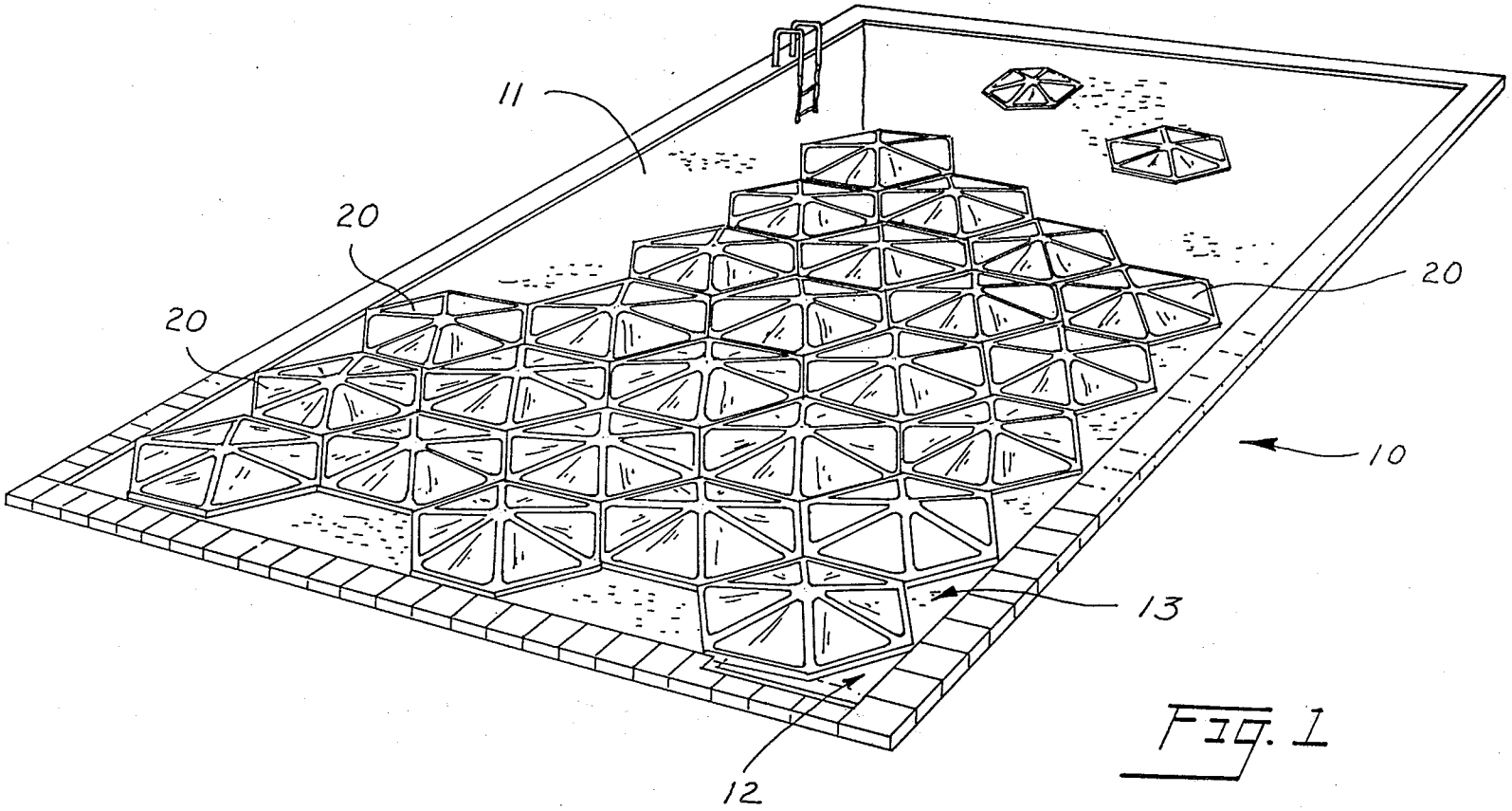
FIG. 1 is a perspective of a swimming pool utilizing a cover of this invention.

With attention directed first to FIG. 1, a swimming pool, generally 10, is illustrated. The surface of the water 11, is shown, and the surface of the water is partially covered by a number like segments 20. For purposes of this illustration the pool is not shown entirely covered, although it will be understood that in actual use the pool will generally be completely covered with the possible exception of certain corner elements, which even then, may be covered in the manner hereinafter described.

It will be noted in FIG. 1, that because of the hexagonal shape, the individual pool cover segments fit together and, in essence, interlock with one another.

It is understood that other shapes could be used effectively, and a few of such shapes are illustrated in some of the drawings and will be described briefly below. While many of the advantages of this invention can be achieved by the use of other shapes, the hexagonal shape is doubtless the preferred shape.

Figure 2:
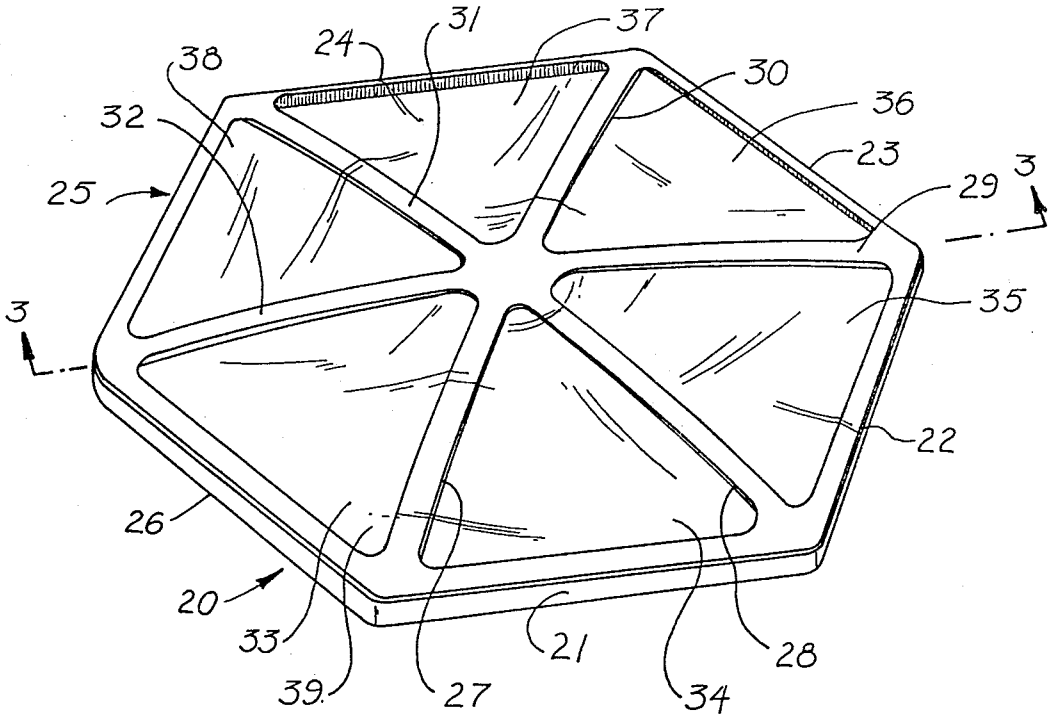
FIG. 2 is an enlarged perspective of one segment of the cover illustrated in FIG. 1.

FIG. 2 shows an enlarged individual segment generally 20 which is molded in a single piece by blow molding or the like, and consists of preferably hollow frame composed of segments 21,22, 23, 24, 25, 26, 27, 28, 29, 30, 31 and 32.

Figure 3:
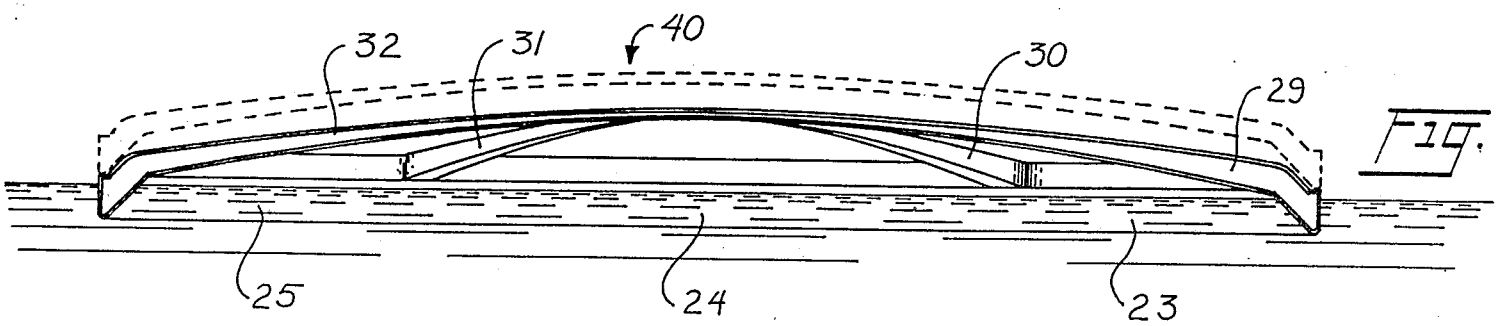
FIG. 3 is a section on 3—3 of FIG. 2, showing in phantom the means for stacking individual segments together.

By glancing at FIG. 3, it can be seen that the shape is somewhat dome shaped, so that the lower segments 21 through 26 essentially form a surface which will float upon the water, and the segments 27 through 32 provide a frame work upon which the skin elements 33, 34, 35, 36, 37, and 38 may rest.

The skin elements may be formed as a unit with the frame by means known to those skilled in the art such as by blow molding. Also, the frame work may be formed individually and the skin elements may be placed upon the frame by utilizing an adhesive or the like together with a suitable material such as polyethylene or similar material having the ability to transmit the heat from the atmosphere towards the pool surface.

FIG. 3 also illustrates in phantom, an element 200 in place upon the element 20 when stacked and stored when not in use. The element 200 is understood to be identical to one of the elements 20 and is merely so numbered for clarity.

Figure 4:
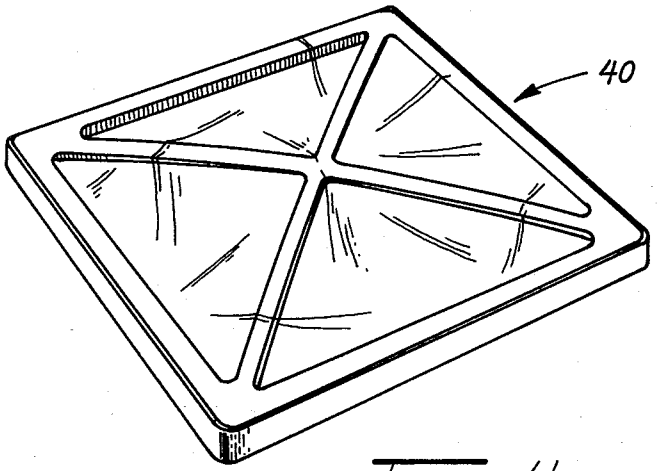
FIG. 4 is an alternate embodiment of a segment of a cover to practice the method of this invention.

With attention directed to FIG. 4 where there is illustrated an alternate embodiment 40 in the form of a square section having a somewhat raised or domed center. The construction will be similar to that of the unit described and shown in FIG. 2 and this construction needs no further amplification.

Figure 5:
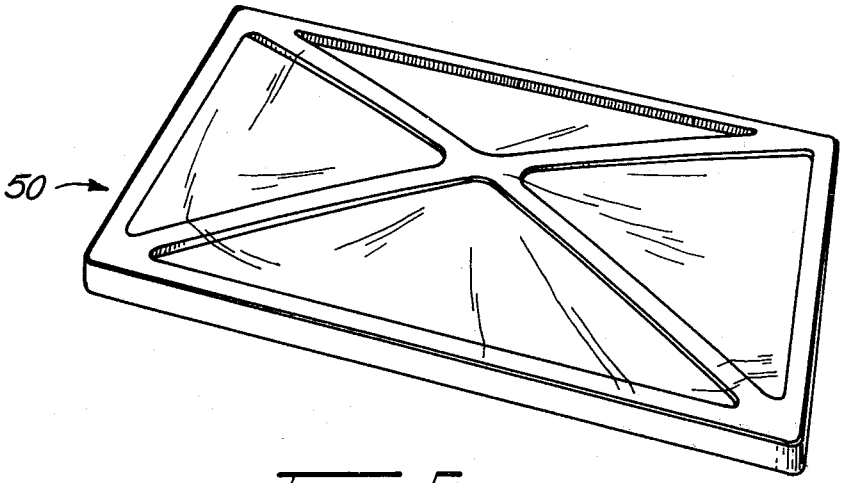
FIG. 5 is another alternate embodiment of a segment of a cover to practice this invention.

Likewise, the element 50 shown in FIG. 5 is merely another configuration, being rectangular in shape. It is to be understood there will be limitless numbers and types of shapes, all being constructed in the same general manner as illustrated in FIG. 2.

Figure 6:
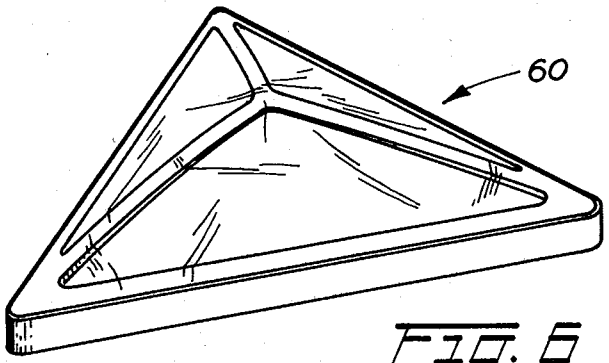
FIG. 6 is another alternate embodiment of a segment of a cover to practice this invention.

FIG. 6 illustrates a particular shape having particular significance and particular utility when used jointly with the shape shown in FIGS. 1, 2 and 3. It will be noted that this is a triangular shape and will be ideally suited to fit into the areas such as 12 and 13 illustrated in FIG. 1 where the hexagonal shape leaves a triangular open space upon the pool surface. By utilizing such a triangular shape (once again formed in a manner identical to the manner described for the hexagonal shape) together with the hexagonal shape it is possible to completely cover a rectangular surface.

Figure 7:
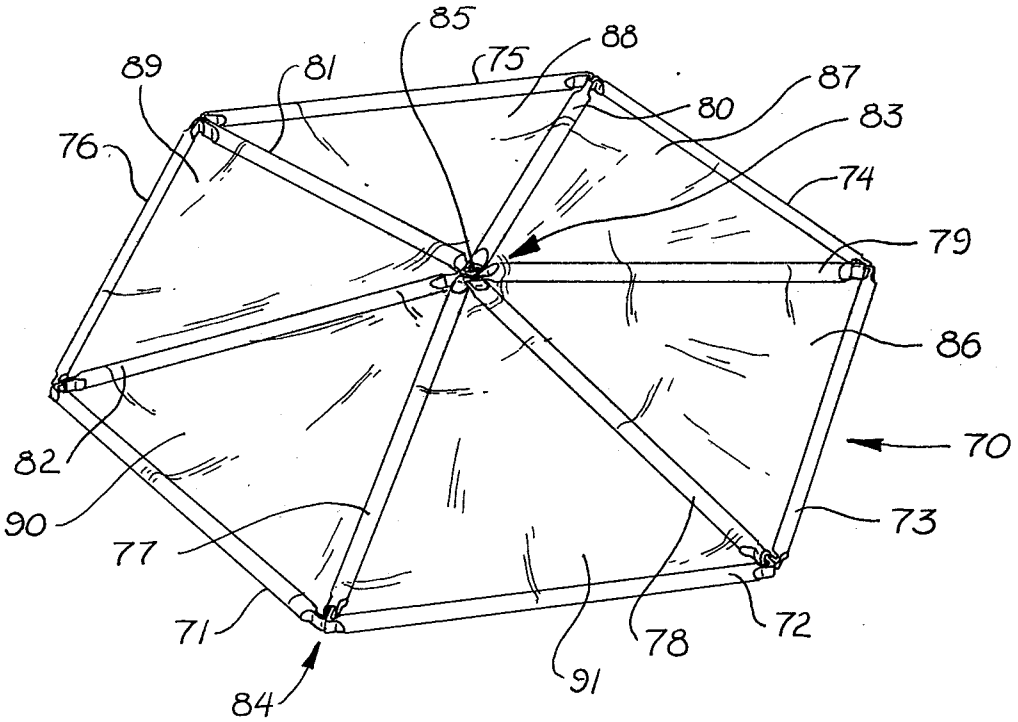
FIG. 7 is another alternate embodiment of a segment of a cover to practice this invention.

FIG. 7 illustrates a unique construction for a segment 70 having the same shape as the shape shown in FIG. 2. It will be observed that the element 70 has been formed from a frame work of pieces of plastic pipe or the like, 71, 72, 73, 74, 75, 76, 77, 78, 79, 80, 81, and 82. In each case, it is observed that the segments 71, 72, 73, 74, 75, and 76 have their ends flattened and angularly disposed as illustrated. The segments 77, 78, 79, 80, 81, and 82 have one end flattened into a somewhat elongated oval shape so as to accommodate two of the flattened ends of adjoining elements such as the segment 77 at its oval end accommodates one of the flattened ends of 71 and one of the flattened ends of 72, thus joining them together.

The other ends of elements 77, 78, 79, 80, 81, and 82 are flattened as illustrated and provided with a hole through which a bolt, or the like 85 is inserted in order to hold these ends together to complete the frame work.

Figure 8:
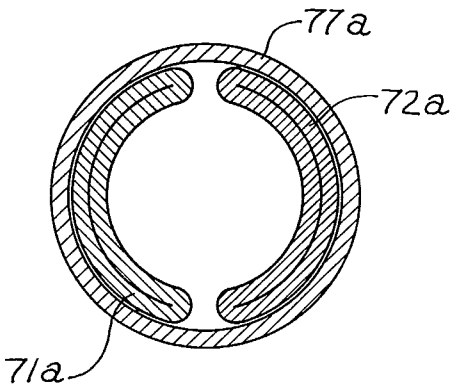
FIG. 8 is an alternate embodiment of the connection of the corners of the embodiment shown in FIG. 7.

FIG. 8 illustrates an alternate construction for the joint area at 84 of a unit made in the manner of the illustration of FIG. 7. In this case it is noted that an end of each of two adjoining segments 71*a* and 72*a*, have been flattened and curved in such manner that the two fit within the unaltered open end of a segment such as 77*a*.

The balance of the construction will be exactly similar to that otherwise illustrated in FIG. 7, that will avoid the necessity of making an oval end upon the segments 77, 78, 80, 81, and 82.

Figure 9:
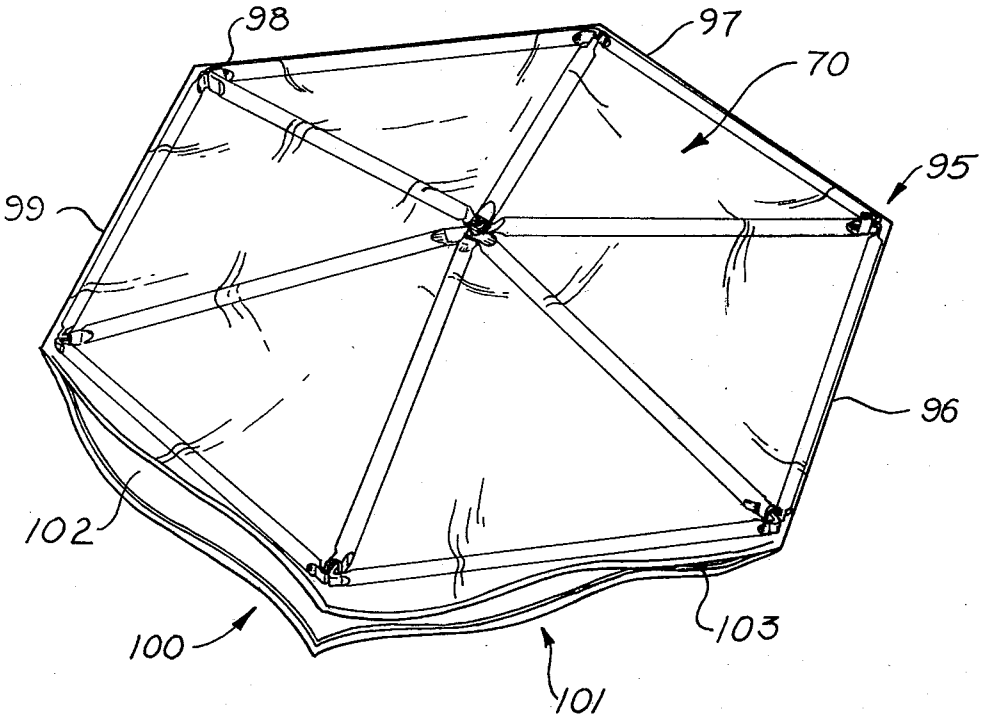
FIG. 9 illustrates a preferred means for providing the covering about the segment of FIG. 7.

The skin elements 86, 87, 88, 89, 90, and 91 may be vinyl or the like sheets fastened to the frame work by adhesive or the like, or may consist of another method of covering a preferred example of which is illustrated in FIG. 9.

In FIG. 9 it is noted that a bag or the like, generally 95, of vinyl, or other suitable material has been formed, having a shape such that it will accommodate an element 70. The bag is sealed at four of its sides, 96, 97, 98 and 99. The two remaining sides, 100, and 101 are provided with openings 102 and 103, which may be sealed by adhesive, by heat sealing, or, preferably, by an easily reopenable sealer such as the well known "ziplok" type fastening as is used on may plastic enclosures.

When utilizing the bag of FIG. 9, the frame work is flipped within the bag and the two open sides are sealed. Thus, there is a complete enclosure around the frame work which may be placed upon the surface of the pool.

Figure 10:
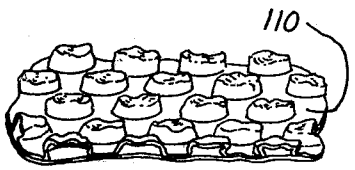
FIG. 10 illustrates the use of a particularly formed plastic material in conjunction with the segments otherwise shown and illustrated.

FIG. 10 illustrates another type plastic which may be used as the covering for a frame work. In this case, the material consists of two sheets of material sealed together repeatedly so as to form a bubble-like effect over its surface. This imparts additional buoyancy to the system. Also, it may enhance the heat insulation qualities.

It is to be noted that it is also possible to make a dual coating of material by having the upper portion of a bag such as that illustrated in FIG. 9 of a clear material and the lower covering of a dark color. In this case the heat transfer qualities may be enhanced.

Further in this, the underside (that next to the water) of the skin, whether in the form of a bag, or a plain skin, may be aluminized or otherwise so treated as to tend to retain the heat in the pool.

It is known that the heat escapes by convection, and by a proper surfacing of the material (not shown, but known in the art) the heat will transfer from outside into the pool area, but will not escape by convection from the pool surface.

It is to be particularly noted, that there is an advantage to the domed-like or arch-like effect of the segments designed by me since this creates a magnification of the heat transfer ability.

While the embodiments of this invention shown and described are fully capable of achieving the objects and advantages desired, it is to be understood that such embodiments are shown for purposes of illustration only, and not for purposes of limitation.

I claim:

1. A cover for a swimming pool comprising: a multiplicity of cover segments each composed of a hexagonal frame of material which is lighter than water, said hexagonal frame defining an hexagonal space within said frame; at least one elongated brace extending between one point upon one side of said hexagonal frame to another point upon another side of said hexagonal frame, and the vertical cross section of the cover being an arch-like shape wherein the height at a midpoint is greater than the height at the perimeter; and, an hexagonal cover of heat transfer sheeting adhered to one side of each of the hexagonal frame elements, completely covering the space within the said hexagonal frame.

2. The apparatus of claim 1 in which a second heat transfer sheet adheres to the other side of hexagonal frame, forming in cooperation with the frame and the first sheet an enclosed space of generally hexagonal shape.

3. A buoyant swimming pool cover comprising: a least one buoyant frame with a horizontally flat base surface, said base surface having a geometric shape perimeter, and a vertical cross section of the frame being a dome-like shape wherein the vertical thickness at a midpoint as greater than the vertical thickness at the perimeter; the frame containing at least one open area which projects from the base surface to an overhead top surface; and, a thermal energy transmitting material covering the frame on at least one surface; wherein a covering of thermal energy transmitting covers the frame upon both sides; and wherein the covering upon top surface of said frame is especially constructed so as to receive thermal energy transmitted by the covering on the base surface of said frame.

4. A buoyant swimming pool cover comprising: at least one buoyant frame with a horizontally flat base surface, said base surface having an hexagonal perimeter, and a vertical cross section of the frame being a dome-like shape wherein the vertical thickness at a midpoint is greater than the vertical thickness at the perimeter; the frame containing at least one open area which projects from the base surface to an overhead top surface; and, a thermal energy transmitting bag fitting over and covering said frame.

* * * * *